US005364166A

United States Patent [19]

Zegeer

[11] Patent Number: 5,364,166

[45] Date of Patent: Nov. 15, 1994

[54] ARM REST FOR CHAIRS, CHAISE LOUNGES AND THE LIKE

[76] Inventor: Peggy C. Zegeer, 392 Kenna Dr., South Charleston, W. Va. 25309

[21] Appl. No.: 550,402

[22] Filed: Jul. 10, 1990

[51] Int. Cl.[5] ..... A47C 7/54

[52] U.S. Cl. ..... 297/411.39

[58] Field of Search ..... 297/411, 414, 415, 417, 297/422, 420, 115, 116, 194, 432, 78, 412, 416, 438, 411.2, 411.3, 411.31, 411.32, 411.35, 411.36, 411.37, 411.38, 411.39; 108/49

[56] References Cited

U.S. PATENT DOCUMENTS

| | | | |
|---|---|---|---|
| 597,473 | 1/1898 | Swain | 297/411 X |
| 709,945 | 9/1902 | Wade | 297/116 X |
| 766,484 | 8/1904 | Armstrong | 297/415 |
| 782,364 | 2/1905 | Soule | 297/411 X |
| 877,274 | 1/1908 | Weber | 297/417 X |
| 1,598,569 | 8/1926 | Fitzhugh | 108/49 |
| 1,721,221 | 7/1929 | Jauregui | 297/411 X |
| 2,477,898 | 8/1949 | Rehman et al. | 297/412 X |
| 2,491,009 | 12/1949 | Lawrence | 297/412 |
| 2,581,023 | 1/1952 | Jerick | 108/145 |
| 2,964,099 | 12/1960 | Panicci | 297/354 |
| 4,252,371 | 2/1981 | Lehnen | 297/27 X |
| 4,565,409 | 1/1986 | Hollonbeck et al. | 297/411 |
| 4,672,898 | 6/1987 | Davidson | 108/6 |
| 4,861,102 | 8/1989 | Fuller | 108/49 |

FOREIGN PATENT DOCUMENTS

| | | | |
|---|---|---|---|
| 22131 | of 1911 | United Kingdom | 297/411 |

*Primary Examiner*—Kenneth J. Dorner
*Assistant Examiner*—Milton Nelson, Jr.
*Attorney, Agent, or Firm*—Jim Zegeer

[57] ABSTRACT

A sun bathing arm rest for a chair, chaise lounge, rocker or the like having an adjusted back rest member, a seat panel member and a ground engaging frame. Each arm rest is adjustably connected to the back rest member in such a way that it remains horizontal when the back rest member is adjusted relative to the seat and is swingable laterally outwardly to provide support for the outwardly extended arms of an occupant.

12 Claims, 4 Drawing Sheets

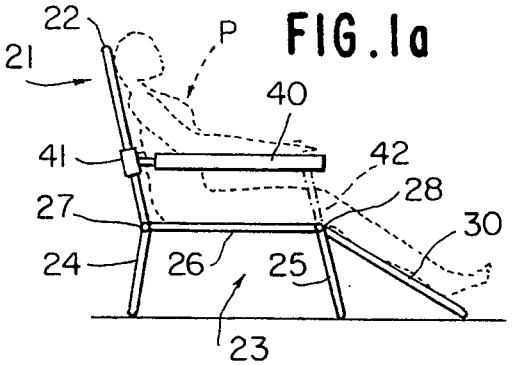
FIG. 1a
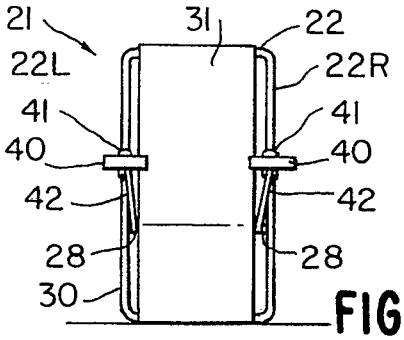
FIG. 1b
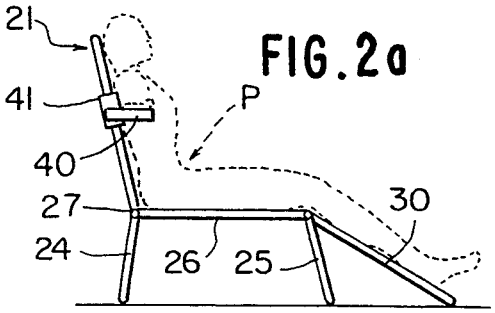
FIG. 2a
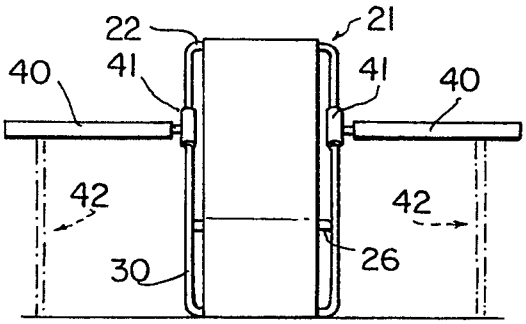
FIG. 2b
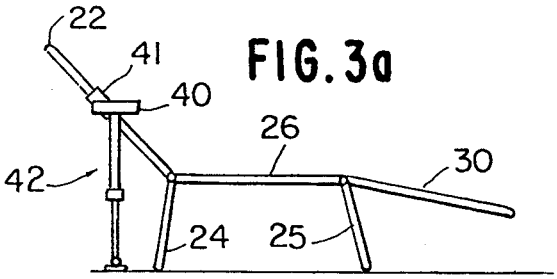
FIG. 3a
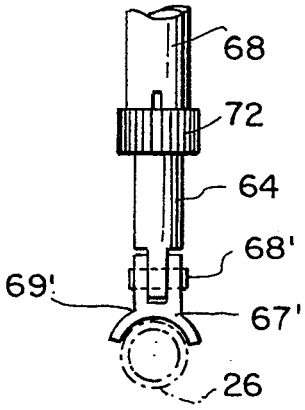
FIG. 5b
FIG. 4
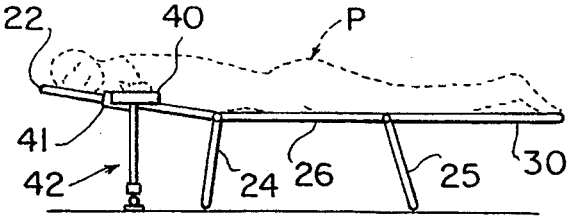
FIG. 3b
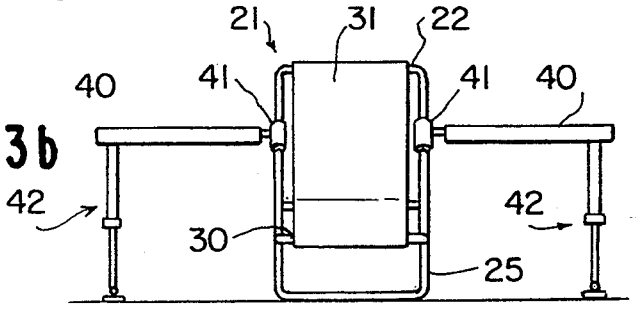

FIG.4b
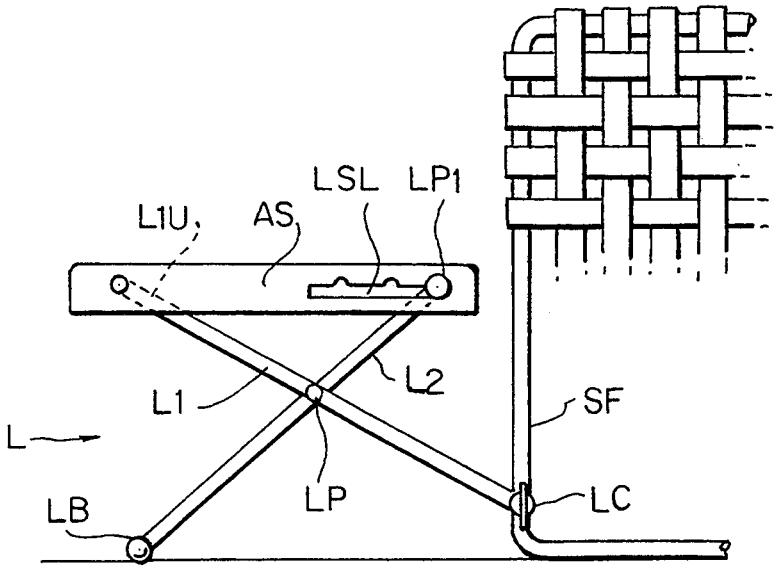
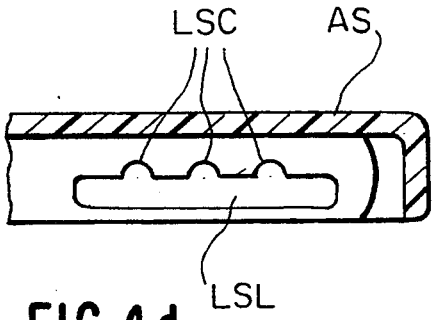
FIG.4d
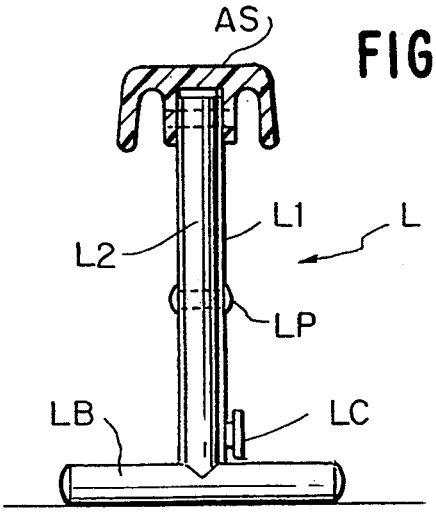
FIG.4c

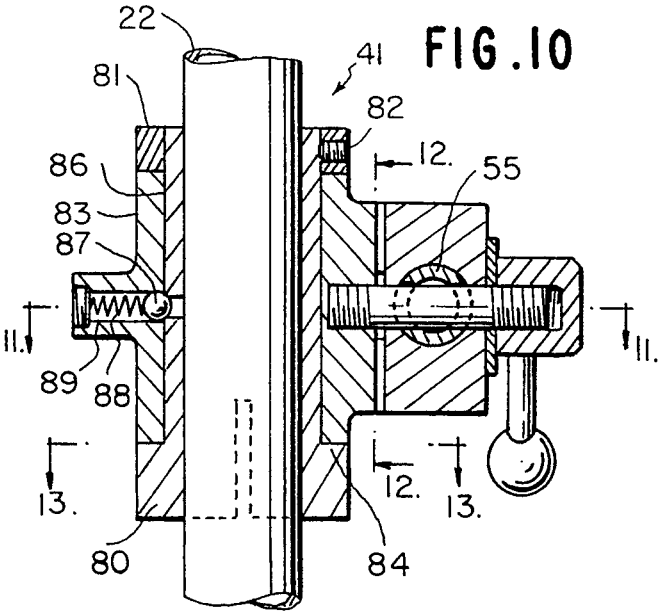
FIG. 10
FIG. 12
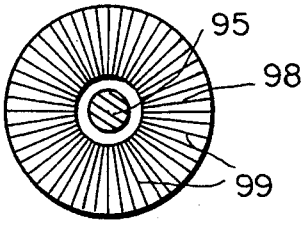
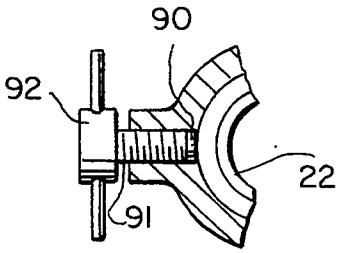
FIG. 11a
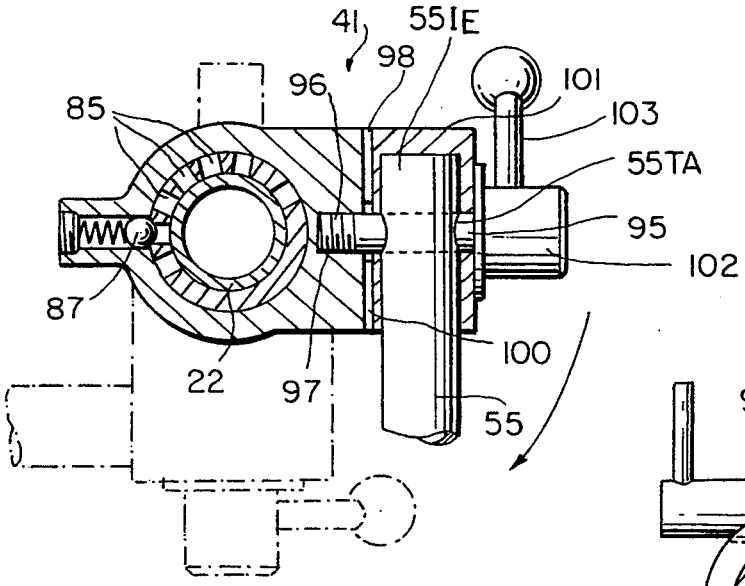
FIG. 11
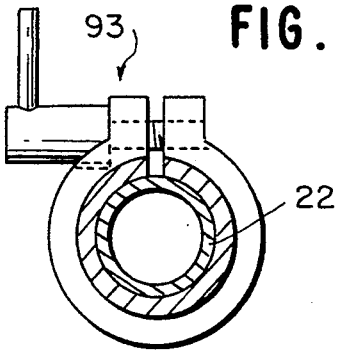
FIG. 13

ARM REST FOR CHAIRS, CHAISE LOUNGES AND THE LIKE

BACKGROUND AND BRIEF DESCRIPTION OF THE INVENTION

This invention relates to arm supports for chairs, chaise loungers, and the like.

Sun bathers and others have difficulty getting both sides of their arms uniformly exposed to the sun's rays. In addition, it is relaxing and enjoyable to spread one's arms laterally outwardly while resting in a chair or reclining. Most folding chaise lounges do not have an arm support or rest and folding chairs generally which do have arm rests have the lower end of the arm rest linked to the seat support and are not laterally swingable so that when a person sits in a chair having arm rests, typically the upper arm portions are maintained close to the body preventing exposure to the sun and air. Moreover, such arm rests typically are vertically aligned with the sides of the chair so that the arms are generally tucked-in closer to the user's sides than is normal and only the wrist and forearm rest upon the chair, and this is particularly true in the case of broad shouldered people.

Accordingly, it is an object of the invention to provide an improved arm rest assembly which may be provided as an attachment for chairs or as a part of the normal construction of a chair. A further object of the invention is to provide a sun bather's arm support which is universally adjustable to any comfortable position selected by the user.

Advantages of the invention are that the arm rest provides support for sun bathers when they are seated, reclining or laying down in a reclining position on a chaise lounger, for example. Another advantage of the invention is that the underarms of the user breathe more freely when the arm rest is at angularly outwardly adjusted in a lateral direction. This is particularly useful in a hospital or nursing home environment. The arm rest may be formed as an attachment which is attached to the lateral frame bars of a chaise lounge chair, for example, or to an already existing chair having tubular frame members. Alternatively, the adjustable arm rest of the present invention may be incorporated in existing chair design so that instead of having a fixed arm rest, the arm rest is laterally adjustable to any degree of adjustment so as to best accommodate a particular user. The forearm and arm support panel is angularly adjustable about the longitudinal axis thereof. An adjustable vertical support post is pivotally connected to the outer end of the arm rest and frictionally retained in a spring yoke snap-in holder.

DESCRIPTION OF THE DRAWINGS

The above and other objects, advantages and features of the invention will become more apparent when considered with the following specification and accompanying drawings wherein:

FIG. 1*a* is a side elevational view of a chaise lounge chair incorporating the invention and FIG. 1*b* is a front elevational view thereof, FIG. 2*a* is a side elevational view of FIG. 1 showing the arm rest extended laterally and elevated somewhat and FIG. 2*b* is a front elevational view thereof, FIG. 3*a* is a side elevational view of a chaise lounge chair incorporating the invention and FIG. 3*b* is a front elevational view thereof, FIG. 4 is a further side elevational view showing the full reclining position of the chaise lounge and the position of the arm rest relative thereto, FIGS. 4*b*, 4*c* and 4*d* illustrate a further embodiment of the invention, FIG. 5*b* is a modification of the support post, FIG. 10 is a sectional view through lines 10—10 of FIG. 5, FIG. 11 is a sectional view through lines 11—11 of FIG. 10 and FIG. 11*a* is a side view of a modification thereof, FIG. 12 is a front elevational view taken on lines 12—12 of FIG. 10, and FIG. 13 is a sectional view on lines 13—13 of FIG. 10.

DETAILED DESCRIPTION OF THE INVENTION

Figures 5, 6, 6A, 7, 8, 8A, 9:
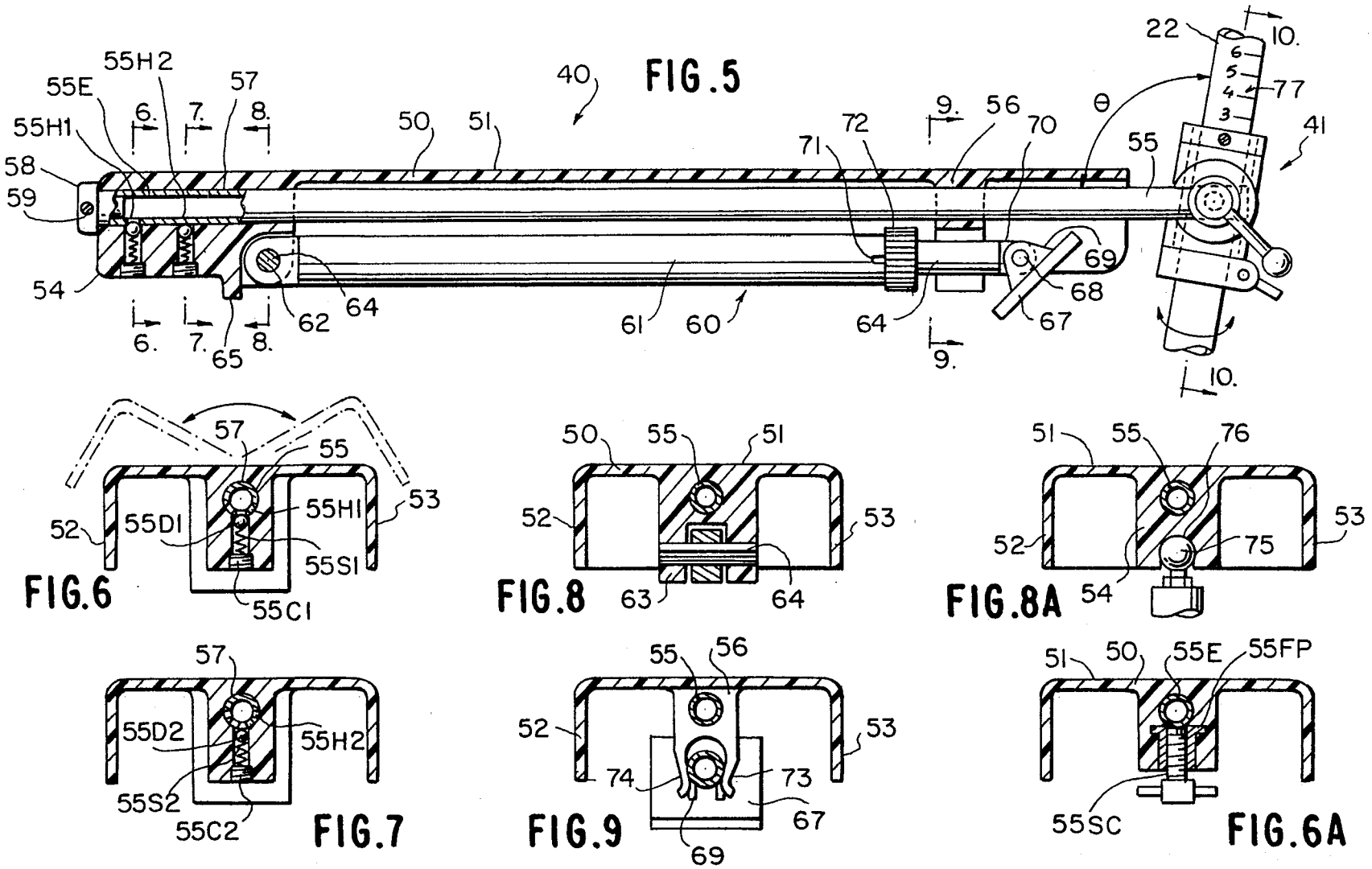
FIG. 5 is a side sectional view of the arm rest incorporating the invention.
FIG. 6 is a sectional view through lines 6—6 showing the rotation of the arm rest relative to the central axis and FIG. 6*a* is a modification thereof.
FIG. 7 is a further sectional view through lines 7—7.
FIG. 8 is a sectional view through lines 8—8 of FIG. 5
FIG. 8*a* is a modification thereof.
FIG. 9 is a sectional view through lines 9—9 of FIG. 5.

In its preferred embodiment, the invention is particularly applicable to folding chaise lounges for sun bathing purposes and in the particular embodiment disclosed herein, a chaise lounge 20 having an adjustable back support 21 constituted by a U-shaped frame 22 which is pivotally adjustable by latching pivots on a seat support 23, the seat support being constituted by a pair of spaced U-shaped ground engaging supports 24, 25 and a seat support 26. Back support 21 is secured by adjustable pivots 27 to the upper end of U-frame support 24 and the rearward end of seat frame 26. Similarly, the front leg support 25 is adjustably connected to the forward end of seat member 26 by an adjustable pivot 28. Moreover, as is also conventional, the chaise lounge has a foot/leg support 30 which is also laterally pivotally connected at 28 by a locking detent pivot (not shown) so that it may be moved to different positions of adjustment as shown in FIGS. 3*a* and 4*a*. Finally, the chaise lounge 20 is provided with body supporting canvas, cross-webbing (FIG. 4*b*), or other material which may extend horizontally between the arms of the back support 22 and the seat portion 26 and leg/foot support 30. In other words, the chaise lounge including its adjusting folding and adjusting mechanisms, is conventional in all respects so that adjustment of the back support 21 is typically by moving the frame 22 forward slightly to disengage a latch in pivot 27 and move it to a new position and latch it. Similarly, the adjustment of leg/-foot support 30 is by elevating it, moving it on an arc slightly to operate the latch mechanism in pivot 28.

The invention is concerned with arm support 40 and its securement device 41 to the chair and vertical support. A person P shown in outline is sitting upright with the foot/leg support 30 having its forward end resting on a deck, patio or ground or the like and its rearward end pivotally connected at 28 to the forward end of seat frame 26. Each side of frame 22 has side bars 22L and 22R and each side bar has fitted thereto an adjustable mounting bracket 41, which are, except for being on the right and left side are identical and will be described more fully hereafter.

As shown in FIG. 1*a*, the forward ends of arm support 40 have a pivotally connected adjustable support 42 and in this embodiment has a bifurcated end (see FIG. 5*a*) which rests on the forward end of the cross bar of frame 26 as shown in FIG. 1*b*.

Referring to FIGS. 2*a* and 2*b*, the person has adjusted the arm support 40 and the adjustable mounting bracket 41 so that the arm rest 40 extends laterally outwardly and in a slightly upward position than normal arm rest position so as to provide a more restful position and enabling the underarms to be aired in any breeze that may be flowing. Moreover, the adjustable arm support members 42 have been elongatedly extended to engage the ground and provide support so that the arms are not merely cantilevered in relieving the loading on mounting bracket 41 and the side members of frame 22.

As shown in FIGS. 3*a* and 3*b*, the back support 22 has been adjusted to a slightly reclining position and the foot/leg support 30 has been elevated to provide a semi-reclining position. In this case, the arm support 40 has been angularly adjusted about its longitudinal axis so as to be horizontal and the user's arms can rest comfortably thereon in a laterally extended position.

Similarly, FIG. 4 discloses the arm support 40 fully laterally extended from mounting bracket 41. Note in this case that the support post 42 has been shortened.

It will be appreciated that instead of being fully laterally outward, the arm support 40 can be adjusted at any angle between the position shown in FIGS. 1*a* to any laterally extending angle even upwardly so that the user can raise the arms above the user's head, if desired. Moreover, the arm supports 40 can be adjusted at different angles relative to each other on each side of the chair and their respective heights can be adjustable by adjusting the length of supports 42. Thus, the invention provides a universally adjustable arm support and is particularly suitable for sun bathing and relaxing purposes on chaise lounge chairs. However, it is to be clearly understood that the invention is not limited to its applicability to chaise lounge chairs and may be applied to any chair having a back support.

Referring now collectively to FIGS. 5–13, the support arm 40 has an arm/hand engaging member 50 which has a generally flat or planar upper surface 51 for receiving the upper and lower arm portions and hand of the user and downwardly depending rim skirts 52, 53 which merge to an end 54. A tubular support arm 55 passes through an integrally molded lug 56 between skirts 52, 53 and the outer-most end 55E of support post 55 passes through a bore 57 in the end 54 of arm 40 and has a closure cap and securement member 58 secured thereto by a set screw 59 so that the arm support member 50 is rotatable relative to support arm 55. Arm support 50 is preferably of molded plastic.

As shown in FIGS. 6 and 7, the end 55E of arm 55 has a pair of spaced holes 55H1 and 55H2 into which detent balls 55D1 and 55D2 are urged by springs 55S1, 55S2 and held in place by cap screws 55C1, 55C2 so that the arm support member 50 can be easily rotated about the axis of support rod 50 and held in the adjusted positions by these detent actions. In the alternative arrangement shown in FIG. 6*a*, a friction pad 55FP is caused to bear against the outer exterior surface of rod end 55E and a set screw 55SC is used to lock the arm in the adjusted position by friction. It will be appreciated that it is not necessary to fully lock it in that it may be tightened so that it will rotate on rod 55 but with some resistance.

An adjustable or telescoping vertical support post 60 has an outer cylindrical member 61 which has a pivot joint 62 in one end which is received between bifurcations 63 molded in the lower surface of arm support 50 and a rolled pin 64P is press-fitted in place so as to permit support post 61 to pivot about the axis of roll pin 64P. A stop member 65 limits the outward movement of telescoping support post 60.

An inner-telescoping member 66 has a freely pivotted pad 67 (or cross rod engaging clevis 67 as shown in FIG. 5*b*), is pivotally mounted on the lower end thereof by a pivot pin 68. Pad 67 has a clevis upper end 69 which spans the lower end 70 of inner post 64. Inner post 64 has an exterior surface which is gripped by the inner end of outer telescoping post 61. As indicated, the lower end of telescoping post 61 is split as at 71 and a threaded cap 72 having a camming surface on the interior thereof is threadably engaged with the lower end of outer telescoping post 61 and cams or swags the sprung ends caused by the splits 71 to tightly grip the exterior surface of post 64 at any desired position of adjustment. It will be appreciated that other means of adjusting the length of the post can be effected, for example, pins and a series of holes can be used to provided stepped adjustments. Positioned below bore or lug 56 are bifurcations 73 and 74 which act as spring fingers to retain the support post 60 in a stowed or tucked position underneath the arm support member 50 and thus provides a snap-in for the arm post support 60.

As shown in FIG. 8*a*, a ball-and-socket may be used to replace the rolled pin 64 and clevis 63 pivot arrangement. The ball 75 is received in a socket 76 in the end 54.

FIG. 5 and FIGS. 10–13 illustrate the mounting bracket for securing to the tubular frame 22 of the back support 20. Note in FIG. 5 the indicia 77 which permits identifying the positions for securement on both sides. The mounting bracket device 41 is adjustable both horizontally and vertically about the axis of chair member 22. It is also adjustable through the angle $\theta$.

Referring now to FIGS. 10–13, the frame member 22 is indicated as being a circular tubular member but it will be appreciated that it may be a rectangular cross-section, a solid wooden member or a solid steel or plastic member. In some cases, it is not necessary for the member to move vertically up and down the member 22 or its equivalent. As shown in FIG. 10, a split ring bushing 80 is clamped at different positions of adjustment on tube 22 by clamp ring 81 and set screw 82. Outer sleeve 83 is rotatably mounted on bushing 80 with one end rotating on shoulder 84 of bushing 80. A series of detent apertures 85 is formed in the bearing surface 86 of bushing 80 and a cooperating detent ball 87 is urged by spring 88 in bore 89 to one of the apertures 85. Thus, the mounting bracket 41 is angularly adjustable about member 22 of the back support as shown in FIG. 11.. Although a 90 degree rotary detent action is illustrated, it will be appreciated that it may be greater or smaller angle as desired. As shown in FIG. 11*a*, instead of the detent action, a friction pad 90 urged by adjustment screw 91 and lever 92 can adjust to friction bearing on exterior surface 86 of bushing 80 so that by loosening the screw 91 and the friction by pad 91, the angular position of mounting bracket 41 can be easily adjusted and then reset by tightening screw 91 against friction pad 90. As shown in FIG. 13, a clamp 93 is mounted at the lower end of bushing 80 and is useful for adjusting the vertical position of the mounting bracket 41 on member 22 of the seat back.

Arm rest support tube 55 has its inner end 55IE provided with a through aperture 55TA through which passes a shaft 95 which has a threaded end 96 which is in threaded engagement with a bore 97 in rotary member 83. The outer face 98 is formed with starburst indentations 99 which cooperates with a similar configuration on the facing surface 100 of arm rest support tube receiving member 101. Rod or shaft 95 is connected to a hub 102 which has a lever arm 103 secured thereto so that when the lever arm is tightened, threaded engagement of the end 96 of shaft 95 with threaded bore 97 draws the facing surfaces 98 and 100 into abutment and thereby latching or locking the arm rest support tube 55 in any selected position of angular adjustment.

The invention can be made of various materials: plastic, fiberglass or the like metals, and can be conveniently be made of moldable plastics, typically low cost resins, ureas, melomines and the like which may be reinforced or laminated with fiberglass or other strengthening material.

In the embodiment shown in FIGS. 4*c, d* and *e*, the arm rest is supported by a linkage L having scissor arms or links $L_1$ and $L_2$ pivotted at Lp. The upper end of link $L_{1U}$ is pivotally connected on the underside of arm support member AS and a clamp LC secures the linkage to the lower end of the cross-webbed seat frames SF. Link $L_2$ has a lateral bar LB at the lower end to prevent rocking and the upper end has a pin LP1 locatable in slot LSL having a plurality of locating scallops LSC in the upper edge of the slot to define a plurality of discrete and stable height adjustments independent of the back rest.

While there has been illustrated and described a preferred embodiment of the invention, it is to be understood that these are merely exemplary and that numerous modifications may be made therein without departing from the spirit and scope of the invention as defined in the appended claims.

What is claimed is:

1. A sun bathing arm rest attachment for a chaise lounge chair having an adjustable back rest member and a seat panel member and a ground engaging frame comprising:

an arm support member having an arm support surface and a surface facing the ground, a linkage pivotally secured to said surface facing the ground, means on said linkage adapted to connect said linkage to said ground engaging frame member, and a lateral bar on said linkage and engaging the ground to prevent rocking of said arm rest.

2. A folding chaise lounge chair having a seat, a back rest adjustable relative to said seat from an upright sitting position to a horizontal reclining position, a ground engaging frame supporting said seat and back rest above ground, and a sun bathing arm rest connected to said back rest, said sun bathing arm rest comprising:

an arm support having an inner end and an outer end and a longitudinal axis, and an arm support surface member, means securing said inner end of said arm support to said back rest for movement laterally relative to said seat and for rotation about said longitudinal axis, said back rest being rotatably mounted on said ground engaging frame, said arm support surface being adjustable relative to a horizontal axis as a function of the rotation of said back rest relative to said seat member, and means providing vertical support to said arm support being pivotally connected to said arm support and expandable to accommodate the varying distances between said arm support and ground when said back rest is rotated relative to said ground engaging frame.

3. A sun bathing arm rest assembly for a chair having a seat and a back rest, said back rest having left and right frame members, latching pivot means adjustably securing said back rest to said seat for movement about a horizontal axis from an upright to a reclining position, each frame member having an axis, said arm rest assembly comprising:

an elongated tubular member having an inner end and an outer end and a longitudinal axis, and an arm support member mounted on and maintained parallel with said elongated tubular support member and spaced from said inner end, means securing said inner end to one of said frame members for rotation (1) about the axis of said frame member laterally toward and away from said seat and, (2) for adjustment in a vertical plane relative to said back rest when said back rest is adjusted relative to said horizontal axis, and means for providing vertical support to said outer end of said elongated tubular member in any adjusted position.

4. The arm rest assembly defined in claim 3 including detent means between said tubular member and said frame member to retain said arm rest assembly in a selected position of rotation about said frame member.

5. The arm rest assembly defined in claim 3 including friction means between said tubular member and said frame member to retain said arm rest assembly in a selected position of rotation about said frame member.

6. The arm rest assembly defined in claim 3 wherein said arm support member is rotatably mounted on said elongated tubular member.

7. The arm rest assembly defined in claim 6 including detent means between said elongated tubular member and said arm support member to retain said support member in a selected position of rotation.

8. The arm rest assembly defined in claim 6 including a friction means between said elongated tubular member and said arm support member to retain said arm support member in a selected position of rotation.

9. The arm rest assembly defined in claim 3 wherein said chair is a chaise lounge chair having a seat, ground engaging frame supporting said seat and said back rest is rotatably mounted on said ground engaging frame and said arm support member is rotatably mounted on said elongated tubular member for angular adjustment about the longitudinal axis of said tubular member.

10. The arm rest assembly defined in claim 9 wherein said means providing vertical support is pivoted to said arm rest assembly and is expandable to accommodate the varying distances between said arm support and ground when said back rest is rotated relative to said ground engaging frame.

11. The arm rest assembly defined in claim 10 wherein said means providing vertical support includes a telescoping post.

12. The arm rest assembly defined in claim 10 wherein said means providing vertical support include a linkage system of pivoted links.

* * * * *